United States Patent [19]

Périard et al.

[11] Patent Number: 4,808,324

[45] Date of Patent: Feb. 28, 1989

[54] LUBRICANT SYSTEM FOR SHEET AND SECTION ROLLING MILLS

[75] Inventors: Jacques Périard, Sins; Hans R. Staub, Eggenwil; Marco Lanini, Sins, all of Switzerland

[73] Assignee: Lonza Ltd., Gampel/Valais, Switzerland

[21] Appl. No.: 32,010

[22] Filed: Mar. 31, 1987

[30] Foreign Application Priority Data

Apr. 4, 1986 [CH] Switzerland ..... 1322/86

[51] Int. Cl.[4] ..... C10M 125/02; C10M 125/00

[52] U.S. Cl. ..... 252/23; 252/18; 252/22; 252/25; 252/29; 252/30; 252/49.3; 252/49.5

[58] Field of Search ..... 252/22, 23, 29, 30, 252/49.3, 49.5

[56] References Cited

U.S. PATENT DOCUMENTS

| | | | |
|---|---|---|---|
| 2,176,879 | 10/1939 | Bartell | 252/22 |
| 2,588,625 | 3/1952 | Ferner et al. | 252/29 |
| 2,719,386 | 10/1955 | Johnson et al. | 252/29 |
| 2,735,814 | 2/1956 | Hodson et al. | 252/23 |
| 3,198,735 | 8/1965 | Lamson et al. | 252/25 |
| 3,242,075 | 3/1966 | Hunter | 252/22 |
| 3,341,454 | 9/1967 | Chor et al. | 252/22 |
| 3,344,065 | 9/1967 | Gansheimer et al. | 252/18 |
| 3,384,580 | 5/1968 | Peace | 252/29 |
| 3,472,770 | 10/1969 | Prestson | 252/23 |
| 3,525,692 | 8/1970 | Dodson et al. | 252/29 |
| 3,770,634 | 11/1973 | Dodson et al. | 252/29 |
| 3,784,588 | 1/1974 | Miles | 260/928 |
| 3,801,504 | 4/1974 | Stone | 252/23 |
| 3,833,502 | 9/1974 | Leary et al. | 252/49.5 |
| 3,838,048 | 9/1974 | Hedge | 252/12 |
| 3,908,038 | 9/1975 | Nienart et al. | 427/27 |
| 3,983,042 | 9/1976 | Jain et al. | 252/18 |
| 4,039,337 | 8/1977 | Brown et al. | 106/38.28 |
| 4,050,932 | 9/1977 | Lemmer | 75/211 |
| 4,052,323 | 10/1977 | Feneberger et al. . | |
| 4,055,503 | 10/1977 | Anselment et al. | 252/29 |
| 4,104,178 | 8/1978 | Jain et al. | 252/30 |
| 4,115,283 | 9/1978 | Needham | 252/12.4 |
| 4,140,834 | 2/1979 | Marcantonio et al. | 252/22 |
| 4,206,060 | 6/1980 | Yamamoto et al. | 252/22 |
| 4,206,061 | 6/1980 | Dodson et al. | 252/29 |
| 4,228,020 | 10/1980 | Papay | 252/29 |
| 4,314,907 | 2/1982 | Defretin et al. | 252/22 |
| 4,321,295 | 3/1982 | Smith-Johansen | 428/206 |
| 4,357,249 | 11/1982 | Mellor | 252/12 |
| 4,575,430 | 3/1986 | Periard et al. | 252/12.6 |

FOREIGN PATENT DOCUMENTS

| | | | |
|---|---|---|---|
| 18799 | 1/1984 | Japan | 252/22 |
| 586195 | 12/1977 | U.S.S.R. | 252/22 |
| 981351 | 12/1982 | U.S.S.R. | 252/22 |
| 1030405 | 7/1983 | U.S.S.R. . | |
| 2036071 | 3/1979 | United Kingdom . | |
| 1569730 | 3/1980 | United Kingdom . | |

OTHER PUBLICATIONS

*Chemical Abstracts*, 85:65528c (Dorn et al.).
*Chem. Abstracts*, 109708k.

*Primary Examiner*—Jacqueline V. Howard
*Assistant Examiner*—E. McAvoy
*Attorney, Agent, or Firm*—Fisher, Christen & Sabol

[57] ABSTRACT

Lubricant system for sheet and section rolling mills, containing a solid lubricant, an adhesive component and/or a thickening agent, and also water as a carrier medium. The lubricant system is sprayed onto the working cylinder in the roll stand as a suspension, at least some of the water evaporating and a firmly adhering, waterproof, lubricating and separating film forming on the working cylinders.

6 Claims, No Drawings

LUBRICANT SYSTEM FOR SHEET AND SECTION ROLLING MILLS

BACKGROUND OF THE INVENTION 1. Field of the Invention

The invention relates to a lubricant system for sheet and section rolling mills.

2. Prior Art

The application of lubricants containing graphite, alkylene polymers or copolymers, film stabilizers and suspension aids for the lubrication of mandrels in rolling mill trains for the manufacture of seamless pipes is known from Swiss Patent Nos. 596,294 and 609,728. The lubricants are sprayed on the hot mandrel in the form of an aqueous suspension, under which circumstances the water evaporates and a lubricating film is left behind in which the graphite particles are present in the alkylene polymer in a uniform distribution. If the mandrel in the roll stand is introduced into the hollow billet, the alkylene polymer melt forms a hydrodynamic lubricating film, the alkylene polymer burns off while rolling and the gases produced are capable of a separating action. The graphite left behind can absorb momentary and local loading peaks and, in general, acts as a dry lubricant.

The attempt to transfer the lubricant specifically to the sheet and section rolling process was unsuccessful. In view of the substantially longer time which is available for applying the lubricant suspension, the evaporation of the carrier medium and the formation of a uniformly thick, waterproof, lubricating film, it was no longer possible for the known lubricants to suffice.

BROAD DESCRIPTION OF THE INVENTION

The main objection of the invention is to provide a lubricant system which is simple to apply and leaves behind a lubricant in the form of a film which ensures satisfactory lubrication between sheets and profiles and the rolls of a rolling mill train. Other objects and advantges of the invention are set out herein and/or are obvious herefrom to one skilled in the art.

The invention lubrication system and use method therefor achieve the objects and advantages of the invention.

The invention involves a lubricant system for sheet and section rolling mills. The invention lubrication system contains a lubricating component (a), which is a solid lubricant, and at least one of components (b) and (c). The component (b) is an adhesive component which is an organic water-insoluble adhesive, which decomposes at a temperature of up to 300° C. and which has a softening point of from 20° to 180° C. The component (c) is a thickening agent for aqueous suspensions, which is an alginate, cellulose, starch, gum or clay, individually or mixed with each other. The invention lubrication system also contains a component (d) in the form of a liquid as a carrier medium.

The lubricant system is used in sheet and section rolling mills, the slabs, for example, from a pusher-type reheating furnace being fed as a rule to a mechanical descaling plant in a highly heated state. Immediately after this, the slabs pass, for example, into a continuous finishing train, usually comprising 6 to 7 roll stands. The rolled sheet or section is then cooled and reeled.

A roll stand consists essentially of two working cylinders situated opposite each other, the sheet or section being passed through the roll nip. When they enter the first roll stand, the slabs have a temperature of about 1200° C., and the sheet or section formed therefrom still has a temperature of around 1000° C. in the third stand. The roll cylinders have, therefore, to be cooled with considerable quantities of water.

DETAILED DESCRIPTION OF THE INVENTION

According to the invention, a lubricant system is expediently used which contains 25 to 95 percent by weight of the component (a) and 5 to 75 percent by weight of the components (b) and (c), and which forms a suspension with the component (d) containing from 5 to 30 percent by weight of the components (a), (b) and (c) in the component (d).

The substances which can be used as the component (a) include solid lubricants, preferably graphite, $MoS_2$, $CaF_2$ or BN. Mixtures thereof can also optionally be used. Preferably synthetic graphite with a particle size of less than 100 μm is used.

The component (b) includes substances from the family of organic water-insoluble, optionally water-swellable, adhesives, which decompose at temperatures up to 300° C. and have a softening point of 20° to 180° C. Of this family the following are preferred: hydrocarbon resins belonging to the cumarone-indene resins family having a softening point of 105° to 145° C., aliphatic and/or aromatic petroleum resin mixtures containing 4 to 10 C atoms in the basic molecules, terpene resins, colophonium derivatives, polyisobutylene, polyamide resins having a mean molecular weight of 6000 to 9000, and mixtures thereof. Adhesive components which are hydrocarbon resins are, for example, thermoplastic resins manufactured from aromatic petroleum cuts. The polyamide resins with a molecular weight of 6000 to 9000 and having adhesive properties include the reactive polyamide resins. Furthermore, the component (b) can be colophonium and also the derivatives of polymerized colophonium or modified colophonium ester. Mixtures of such adhesive compounds can also be used if appropriate.

Within the scope of the invention, bitumens, such as Grahamite and Gilsonite, can also be used as the adhesive component (b). All the invention advantages cannot, however, be achieved with these adhesive compounds, in particular, the transfer effect is absent.

Advantageously, the component (b) can also be a mixture of at least one of the above-mentioned adhesive compounds with paraffins or waxes. In this case, the paraffins or waxes should not, however, be more than 50 percent by weight of the total quantity of resin.

The component (c) includes thickening agents which are used for the manufacture of aqueous suspensions. The component (c) can be the alginates, celluloses such as alkyl and hydroxyalkylcelluloses, carboxymethylcelluloses, hydroxyethylcelluloses and hydroxypropylcelluloses, gums such as guar gum, agar gum, gum arabic, gum ghatti, karaya gum, tragacanth gum, locust bean gum, tamarind gum and xanthan gum, pectins, polyacrylamides, polyacrylic acids and their homologues, polyethylene glycol, polyethylene oxide, polyvinyl alcohol, polyvinyl acetate, polyvinylpyrrolidone, starch and modifications thereof, pastes such as starch and cellulose pastes, carrageen, polysaccharides, water glass clays, in particular the high-plasticity clays, montmorillonite, bentonite, kaolin, modified montmorillonite, hectorite, attapulgite and the derivatives of said substance groups and mixtures of such substances with one another, but the clays, as inorganic substances, should not form more than 20 percent by weight of the component (c).

Further, preferred compositions of the lubricant systems contain 30 to 90 percent by weight, preferably 40 to 90 percent by weight, of the component (a).

The components (b) and (c) should be 5 to 75 percent by weight of all three components (a), (b) and (c) and can consist of 0 to 75 percent by weight of the component (b) and 0 to 75 percent by weight of the component (c). Preferred compositions contain 25 to 95 percent by weight of the components (a) and 5 to 75 percent by weight of the component (b).

The invention lubricant systems are remarkable for the fact that the dry lubricant adheres rapidly and reliably to the roll surface.

Further preferred compositions contain 25 to 95 percent by weight of the component (a) and 5 to 75 percent by weight of the component (c). The high proportion of thickening agents achieves the result that a stable aqueous solution is achieved and a good film formation and adhesion of the dry lubricant to the rolls can be observed even after the evaporation of the carrier medium.

Excellent results can be achieved with a system which contains 40 to 95 percent by weight of the component (a) and 5 to 60 percent by weight of the component (c).

The component (d) is the carrier medium for the components (a), (b) and (c). Water can be used preferably as the carrier medium. Water volatilizes readily at the processing and application temperatures of the lubricant systems without leaving behind or evolving any injurious exhaust gases or decomposition products.

A carried medium is necessary in order to convert the various components to a form in which they can be processed, i.e., spread-coated and preferably sprayed on. The carrier medium is used to produce a homogeneous suspension. The homogeneity is preserved by the novel invention composition even during transport of the suspension to the processing site and after spraying. At least some of the carrier medium evaporates even during spraying and at the latest, when the lubricant system reaches the roll cylinders, while the remaining components, still homogeneously distributed, form an adhesive and now waterproof film. As soon as the roll cylinders come into contact with the sheet or section, the organic constituents start to burn off and thus produce a gaseous separating cushion. As long as organic constituents are still present, the graphite particles are adhesively retained and are capable of developing their lubricating action in a uniformly distributed manner. In addition, the lubricating efficiency of the graphite is fully retained even after all of the organic constituents have burned off.

It can be advantageous to add from 0.1 up to 5 percent by weight of waterglass to the lubricant system. On the one hand, the waterglass has a lubricating action at high temperatures, and on the other hand, it is a film-forming agent for the lubricants.

In order to prevent bacterial attack, in particular in the presence of starch or pastes, it is advantageous to add quantities of from 0.1 to 3 percent by weight of a bactericide or biocide to the lubricant.

Suspension aids and tensides are also not necessary for the stability of the suspension and sometimes are even undesirable. The object is to achieve stability of the suspension primarily through the viscosity by means of the thickening agents.

It is to be assumed that the hydrodynamic lubricant film, as described in the state of the art, for example, in Swiss Pat. No. 596,294, cannot form in the present application since the residence time of the lubricant on the roll surface before the sheet or section is processed is too short. It has now been found that for sheet and section rolling, the specific requirements in relation to lubrication and separation are fulfilled by the novel invention lubricant.

In addition, it has been found that a transfer effect is established with the lubricant system according to the invention. The roll stands downstream of the stand lubricated with a lubricant according to the invention also exhibit substantial energy savings and wear reductions. This occurs without the subsequent stands being lubricated.

The novel invention lubricants can be manufactured in a manner such that the individual components are premixed without the carrier medium. These constituents are, as a rule, supplied in dry powdered form, it being possible to predetermine the particle size of the powders and to select them and mix them together according to the requirements. The dry powder mixture can then also be easily packed and transported. In the vicinity of the rolling mill, the dry lubricant powder can be mixed and dispersed in a suitable mixer with the carrier medium, as a rule water, to produce the required lubricant system in the form of a stable homogeneous suspension. This suspension remains stable over long periods of time and is then advantageously applied to the roll cylinders via spray nozzles at 20 to 150 bar and in quantities of 0.5 to 5 1 per min. per spray nozzle.

As used herein, all parts, ratios, proportions and percentages are on a weight basis unless otherwise stated herein or otherwise obvious herefrom to one skilled in the art.

EXAMPLE 1

By the dry premixing of:

35 percent by weight of graphite (particle size less than 100 μm), 40 percent by wieght of ground hydrocarbon resins with a softening point of 100° C., 10 percent by weight of starch paste, 5 percent by weight of carboxymethylcellulose, and 10 percent by weight of bentonite, a solid lubricant was produced which was suspended in water in an intensive mixer to produce a solid lubricant system with a 10 percent by weight solids content.

The suspension was sprayed over the whole roll width onto the two working cylinders of the first stand of a finishing train inside of a sheet rolling mill at 60 bar via eight nozzles each delivering 1.2 l/min. The rolled sheets exhibited a substantially improved quality which revealed itself in an improved roughness, i.e., an excellent surface quality. In addition, an essential feature was a reduction in the energy consumption of the roll stand by an average of 15 percent and a reduction in the roll wear of 35 percent. In addition, it was observed that a transfer effect was established so that the second stand exhibited a further 10 percent reduction in energy consumption and an 8 percent reduction in roll wear, and the third stand exhibited a still further reduction of 8 percent in energy consumption.

EXAMPLE 2

The procedure was as in Example 1. Again a solid lubricant system with a 10 percent solids content was produced in an aqueous suspension. The solid lubricant contained:

88 percent by weight of graphite (particle size less than 100 μm), 1 percent by weight of waterglass and 11 percent by weight alkylcellulose.

This suspension was sprayed onto the working cylinders of the first stand by means of eight nozzles in a quantity of 0.7 1/min. per nozzle. The results are shown in Table I:

TABLE I

| Stand | Reduction in Energy Consumption | Reduction in Wear |
|---|---|---|
| Stand 1 | 10% | 25% |
| Stand 2 | 8% | 5% |
| Stand 3 | 6% | |

EXAMPLE 3

The following solid lubricant systems with a 5 percent by weight solids content, each taking the form of an aqueous suspension, were prepared:

TABLE II

| | Solid Lubricant | Adhesive Components | Thickening Agent | Other Components |
|---|---|---|---|---|
| (A) | 34% graphite, less than 100 μm | 59% ground hydrocarbon resin with softening point of 100° C. | 4% waterglass 2% poly-saccharide | 1% biocide |
| (B) | 31% graphite, less than 100 μm | 20% starch paste 16% ground hydrocarbon resin with softening point of 100° C. | 17% bentonite 12% carboxy-methylcellulose 2% waterglass | 2% biocide |
| (C) | 40% graphite, less than 100 μm | 39% ground hydrocarbon resin with softening point of 100° C. | 8% bentonite 1% waterglass 1% carboxy-methylcellulose | 1% biocide |

When used for sheet rolling in the first stand of the rolling mill train, results for energy consumption and roll-wear were obtained which were comparable with the results from Examples 1 and 2.

What is claimed is:

1. Lubricant system for sheet and section rolling mills, said lubrication system consisting of (a) a lubricating component which is a solid lubricant, said component (A) being selected from the group consisting of graphite, $MoS_2$, $CaF_2$, BN and a mixture of at least two of said solid lubricants, (B) a component which is an organic water-insoluble adhesive, which decomposes at a temperature of up to 300° C. and has a softening point of from 20° to 180° C., said component (B) being a hydrocarbon resin selected from the group consisting of (i) at least one resin from the cumarone-indene resin family, (ii) a terpene resin, (iii) a colophonium derivative, (iv) a polyamide resin having a mean molecular weight of 6000 to 9000, (v) a mixture of at least two hydrocarbon resins (i), (ii), (iii) and (iv), (vi) a mixture of at least one of hydrocarbon resins (i), (ii), (iii), and (iv) with at least one wax, at least one paraffin or both, the waxes and paraffins forming not more than 50 percent by weight of the total quantity of said component (B), and (vii) a mixture of (a) aliphatic petroleum resins, aromatic petroleum resins or both, said petroleum resins containing 4 to 10 C atoms in the basic molecules, and (b) at least one member selected from the group consisting of hydrocarbon resin (i), hydrocarbon resin (ii), hydrocarbon resin (iii), hydrocarbon resin (iv), a wax and a paraffin, the waxes and paraffins forming not more than the total weight of the total quantity of said component (B), (C) a component which is a thickening agent for aqueous suspensions, said component (C) being at least one member selected from the group consisting of an alginate, a cellulose, polyethylene oxide, carrageen, cellulose ether, a gum, a pectin, a polyacrylamide, a polyacrylic acid, polyethylene glycol, a polyvinyl alcohol, polyvinyl acetate, polyvinylpyrrolidone, starch, starch paste, cellulose paste, a polysaccharide, waterglass and a high-plasticity clay, the clay forming as an inorganic substance, not more than 20 percent by weight of component (C), and (D) water as a carrier medium, there being 25 to 95 percent by weight of said component (A) based upon the total weight of said components (A), (B) and (C), there being 75 to 5 percent by weight of said components (B) and (C) based upon the total weight of said components (A), (B) and (C), component (B) being present in an amount which is effective as an adhesive in said lubrication system, there being 5 to 30 percent by weight of said components (A), (B) and (C) based upon the total weight of said component (D), and said components (A), (B) and (C) forming a suspension with said component (D).

2. Lubricant system according to claim 1 wherein the lubricant system contains 30 to 90 percent by weight of the component (A), based upon the total weight of said components (A), (B) and (C).

3. Lubricant system according to claim 1 wherein the lubricant system contains 40 to 90 percent by weight of component (A), based upon the total weight of said components (A), (B) and (C).

4. Lubricant system according to claim 1 wherein the lubricant system contains 6 to 60 percent by weight of component (C), based upon the total weight of said components (A), (B) and (C).

5. Method for lubricating rollers in the manufacture of sheets and sections in sheet or section rolling mills by means of a lubricant system according to claim 1 wherein a suspension containing 5 to 30 percent by weight of component (A) and at least one of components (B) and (C) in carrier medium (D) is applied to the two working cylinders of at least one roll stand, some of the carrier medium escaping during the application, in gas form and a firmly adhering, waterproof, lubricating and separating layer, forming on the working cylinders.

6. Lubricant system for sheet and section rolling mills, said lubrication system consisting of (A) a lubricating component which is a solid lubricant, said component (A) being selected from the group consisting of graphite, $MoS_2$, $CaF_2$, BN and a mixture of at least two of said solid lubricants, (B) a component which is an organic water-insoluble adhesive, which decomposes at a temperature of up to 300° C. and has a softening point of from 20° to 180° C., said component (B) being a hydrocarbon resin selected from the group consisting of (i) at least one resin from the cumarone-indene resin family, (ii) a terpene resin, (iii) a colophonium derivative, (iv) a polyamide resin having a mean molecular weight of 6000 to 9000, (v) a mixture of at least two hydrocarbon resins (i), (ii), (iii) and (iv), (vi) a mixture of at least one of hydrocarbon resins (i), (ii), (iii), and (iv) with at least one wax, at least one paraffin or both, the waxes and paraffins forming not more than 50 percent by weight of the total quantity of said component (B), and (vii) a mixture of (a) aliphatic petroleum resins, aromatic petroleum resins or both, said petroleum resins containing 4 to 10 C atoms in the basic molecules, and (b) at least one member selected from the group consisting of hydrocarbon resin (i), hydrocarbon resin (ii), hydrocarbon resin (iii), hydrocarbon resin (iv), a wax and a paraffin, the waxes and paraffins forming not more than the total weight of the total quantity of said component (B), (C) a component which is a thickening agent for aqueous suspensions, said component (C) being at least one member selected from the group consisting of an alginate, a cellulose, polyethylene oxide, carrageen, cellulose ether, a gum, a pectin, a polyacrylamide, a polyacrylic acid, polyethylene glycol, a polyvinyl alcohol, polyvinyl acetate, polyvinylpyrrolidone, starch, starch paste, cellulose paste, a polysaccharide, waterglass and a high-plasticity clay, the clay forming as an inorganic substance, not more than 20 percent by weight of component (C), and (D) water as a carrier medium, and (E) a bactericide or biocide, there being 25 to 95 percent by weight of said component (A) based upon the total weight of said components (A), (B), (C) and (E), there being 0.1 to 3 weight percent of component (E) based upon he total weight of said components (A), (B), (C) and (E), there being 75 to 5 percent by weight of said components (B) and (C) based upon the total weight of said components (A), (B), (C), and (E) component (B) being present in an amount which is effective as an adhesive in said lubrication system, there being 5 to 30 percent by weight of said components (A), (B), (C) and (E) based upon the total weight of said component (D), and said components (A), (B), (C) and (E) forming a suspension with said component (D).

* * * * *